US005328500A

United States Patent [19]

Beltz et al.

[11] Patent Number: 5,328,500

[45] Date of Patent: Jul. 12, 1994

[54] METHOD FOR PRODUCING METAL POWDERS

[76] Inventors: Robert J. Beltz, 743 Main St.; Joseph D. Dankoff, R.D. #5, Box 19, both of Latrobe, Pa. 15650; Melvin L. McClellan, 111 Corbin Ave., Beaver Falls, Pa. 15202

[21] Appl. No.: 901,875

[22] Filed: Jun. 22, 1992

[51] Int. Cl.[5] ..... B22F 1/00

[52] U.S. Cl. ..... 75/343; 75/236; 75/242; 75/246; 75/252; 75/255; 75/351; 419/10; 419/17; 419/31

[58] Field of Search ..... 75/343, 351, 236, 242, 75/246, 255, 252; 419/10, 17, 31

[56] References Cited

U.S. PATENT DOCUMENTS

| | | | |
|---|---|---|---|
| 3,591,349 | 7/1971 | Benjamin | 75/243 |
| 3,623,384 | 11/1971 | Benjamin | 75/235 |
| 3,785,801 | 1/1974 | Benjamin | 75/255 |
| 3,865,586 | 2/1975 | Volin et al. | 419/15 |
| 4,443,249 | 4/1984 | Weber et al. | 75/352 |
| 4,557,893 | 12/1985 | Jatkar et al. | 419/12 |
| 4,705,556 | 11/1987 | Beltz et al. | 75/235 |
| 4,799,955 | 1/1989 | McClellan | 75/247 |

OTHER PUBLICATIONS

*Metals Handbook* (9th Ed.), vol. 7: Powder Metallurgy; American Society for Metals, 1984, pp. 182 and 185.

*Primary Examiner*—R. Dean
*Assistant Examiner*—Robert R. Koehler
*Attorney, Agent, or Firm*—Nils H. Ljungman & Associates

[57] ABSTRACT

A method for producing a metal composite powder, such as a high alloy metal composite powder, which includes pretreating the alloying components prior to milling with a base iron powder. A short milling time is used, yielding a metal composite powder which exhibits good compactability, microstructure, controllable flow, post-sintering homogeneity, and offers a more economical production method.

23 Claims, 5 Drawing Sheets

10 μm

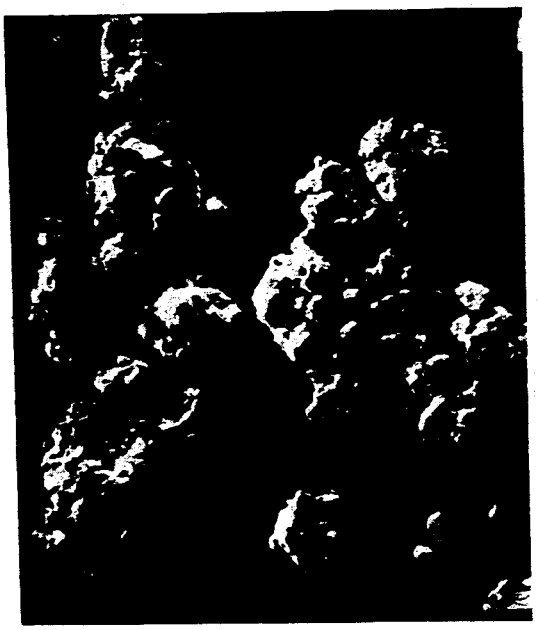
FIGURE 2a 60 μm
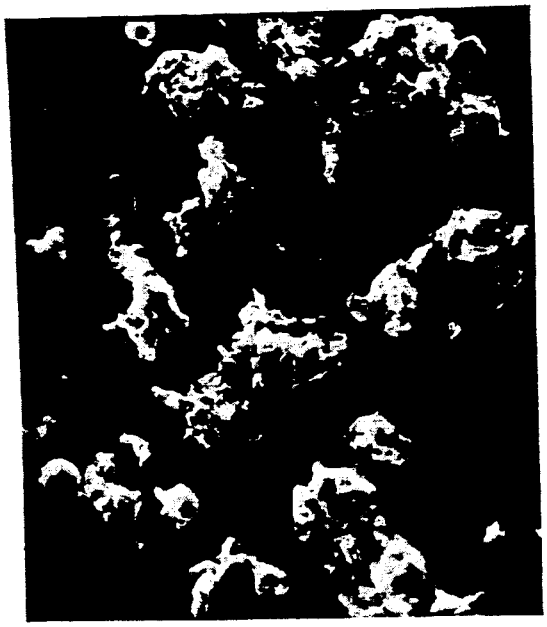
FIGURE 2b 60 μm
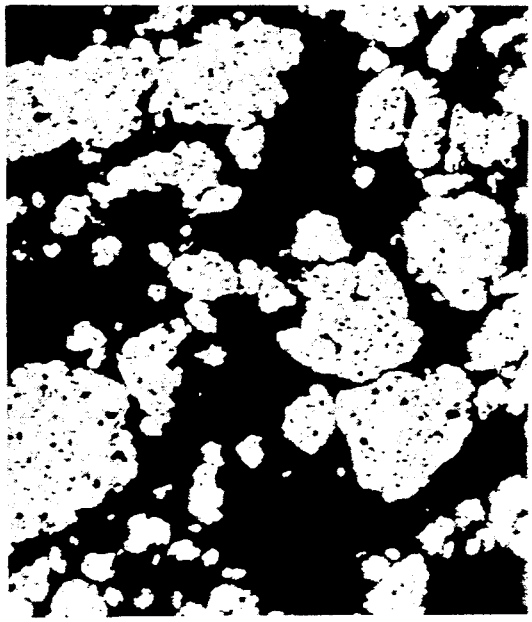
FIGURE 3 20 μm
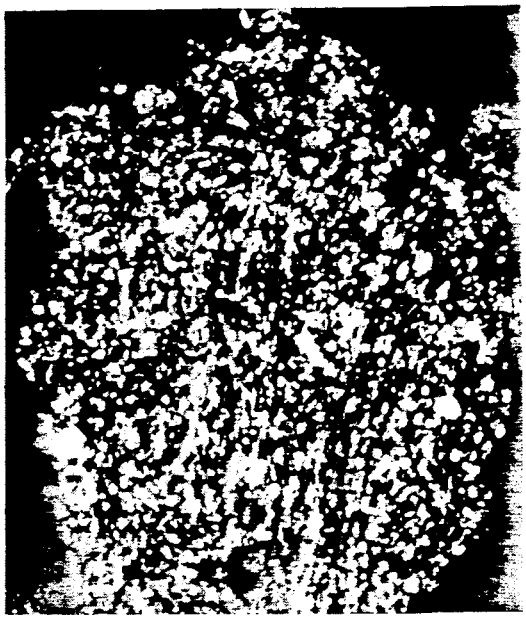
FIGURE 4 10 μm

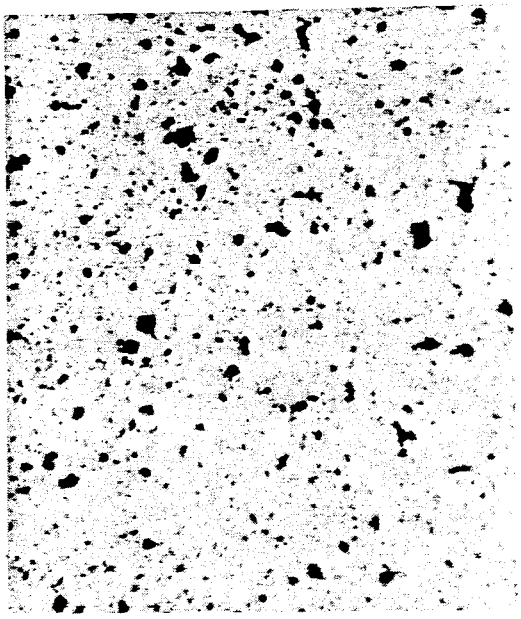
FIGURE 5a 10 μm
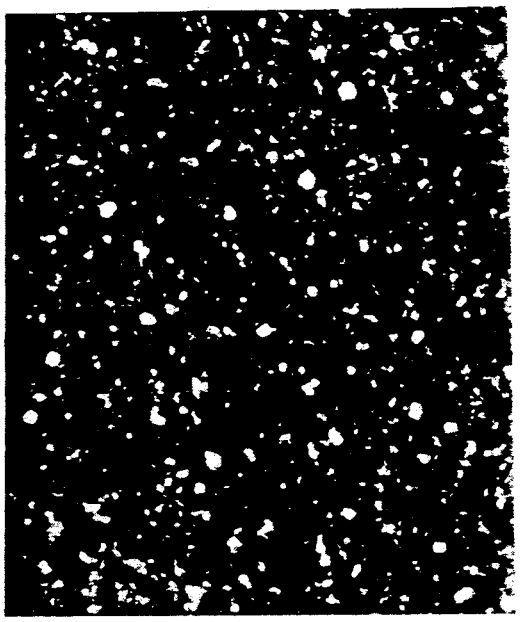
FIGURE 5b 10 μm
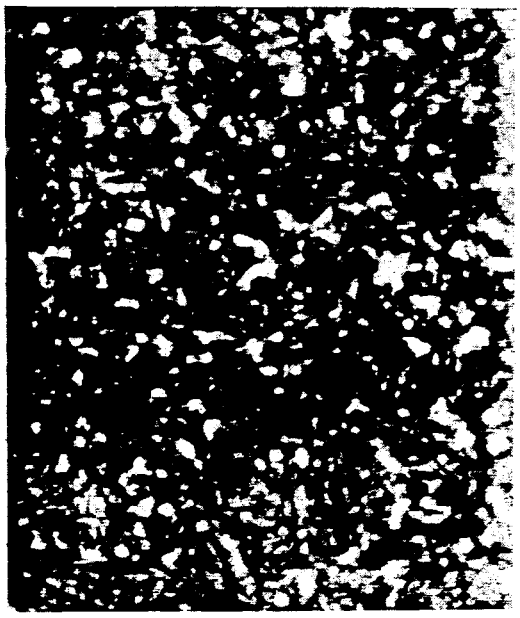
FIGURE 6 10 μm
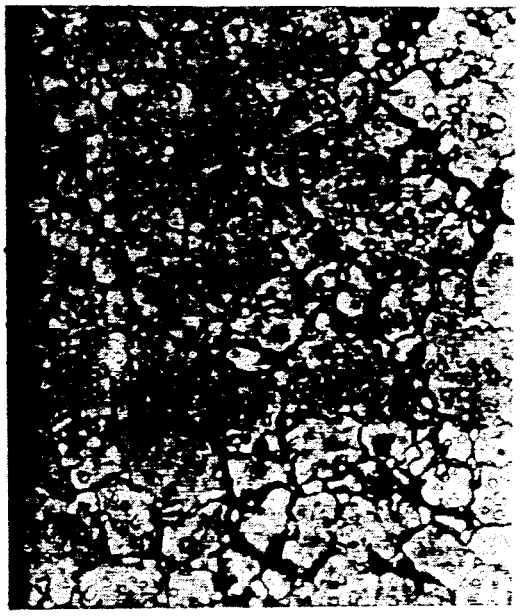
FIGURE 7 20 μm

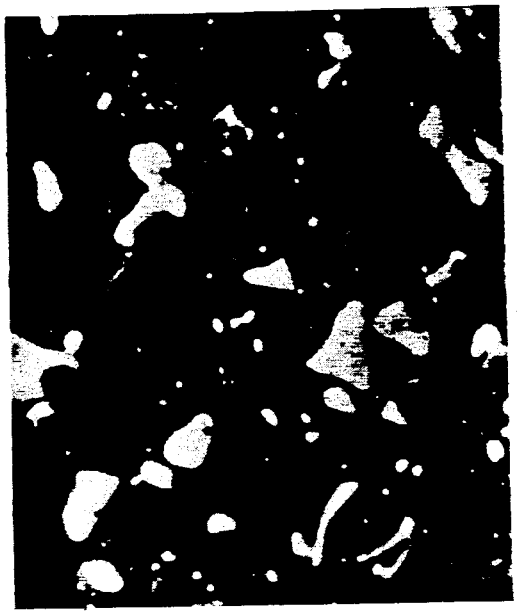
FIGURE 9a 10 μm
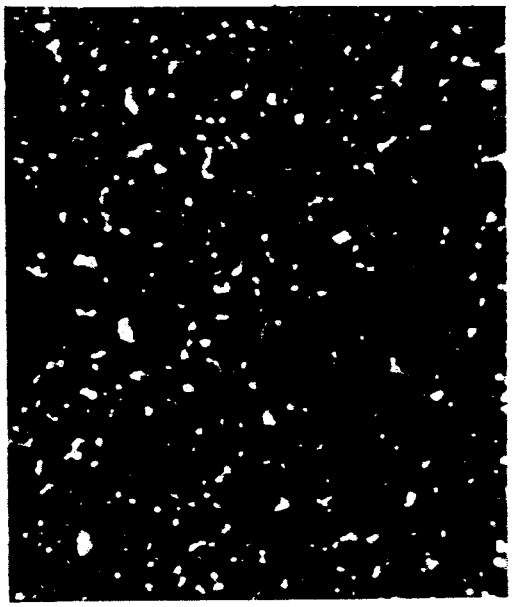
FIGURE 9b 10 μm
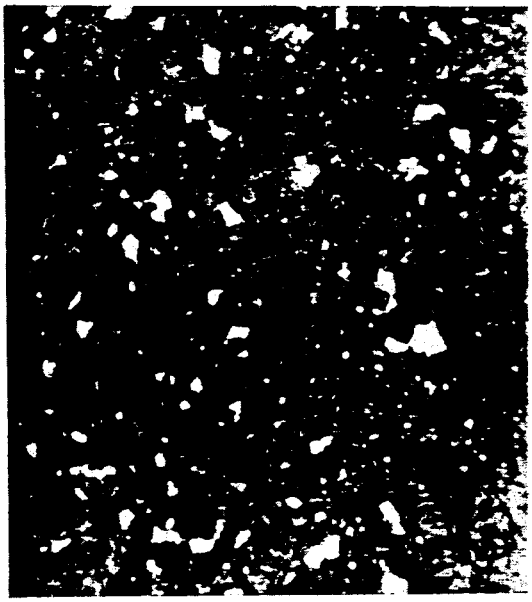
FIGURE 10
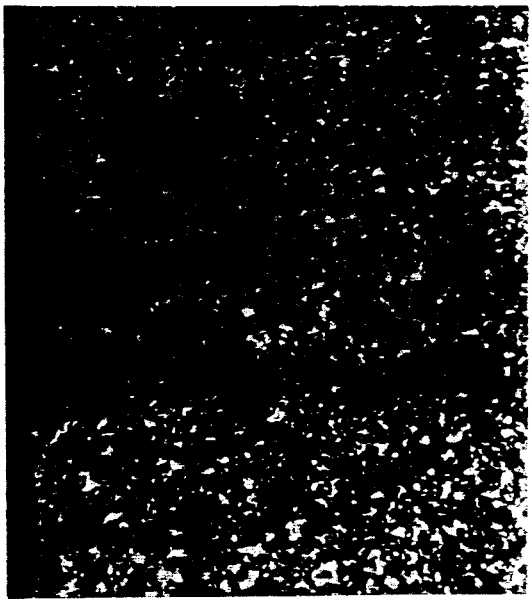
FIGURE 11

METHOD FOR PRODUCING METAL POWDERS

BACKGROUND OF THE INVENTION

1. Field of the Invention:

The present invention relates to powder metallurgy and specifically to iron alloys made thereby, wherein powders, which may be used, for example, in the manufacture of pressed and sintered powder metallurgical parts, are produced by a dry milling process.

2. Background Information:

Metal powders are used in powder metallurgy practice to form hardened metal parts by compressing the powder to a compacted shape and then by heating the compacted metal powder to form a coherent mass. The heating, or sintering, step may be done with or without mechanical deformation during the heating step. The present invention relates to a method for producing steel, with particular emphasis on high alloy steels and high speed tool steels. Further discussion of what constitutes these and various other steels is discussed in *The Making, Shaping, and Treating of Steel,* Association of Iron and Steel Engineers, 10th edition, 1985, pages 1289–1320.

In principle, alloy steels, as an example, can be manufactured simply by the mixing of iron and other elemental metal powders followed by the compacting and sintering of such mixtures. In one method of powder preparation, an elemental admixture, which may be made by simply blending an unalloyed iron powder with the alloying ingredients, forms a soft powder which is easily compactable. However, after sintering, an elemental admixture is likely to result in a product which is non-homogeneous and has poor mechanical properties.

It will be appreciated that easy compaction, or compressibility, is desired in that, in general, the higher the density of the compacted parts prior to sintering, the smaller the dimensional changes which occur as a result of the sintering process. Secondly, good compressibility results in less wear on the compaction dies used in the process of forming the hardened final product. Compressibility may be measured or defined in terms of the density achieved in a part after a given amount of applied compaction pressure. Thus, for example, a metal powder A, which was compressed at 40 tons/in$^2$ and achieved a density of 6.9 g/cm$^3$ would be said to have a better compressibility than powder B which, when compacted at the same pressure, 40 tons/in$^2$, achieved a density of only 6.2 g/cm$^3$.

Another method, for producing a partially pre-alloyed powder, includes blending an elemental admixture and immediately heating the mixture to a temperature at which the alloying ingredients are diffusion bonded to the surface of the iron powder. This method results in only marginally improved homogeneity. Further, if hard or abrasive compounds, such as carbides, are formed at the diffusion bonded interface, this method may lead to excessive die wear, an event of considerable economic disadvantage to the manufacturer.

The most common method, producing a completely pre-alloyed powder, consists of melting the desired alloy and then spray atomizing a liquid metal alloy stream to produce the powder. The powder produced by this method is very homogeneous, but is generally very hard, and also results in excessive die wear from cold-compaction difficulty. Further, alloy powders made in this manner are typically very expensive to produce and are frequently poorly sized.

Further, in the case of production of high alloy steels, attempts have been made to use mixtures of elemental powders and graphite, and also to use mixtures of iron powder with pre-melted carbides. Such mixtures result in a product with properties less than desired because sintering of this powder to near-full density has proven to be virtually impossible. In fact, it is often the case that swelling rather than densification of a pressed compact occurs when such mixtures are sintered.

OBJECT OF THE INVENTION

The object of the present invention is to provide an improved method for more economical production of metal powders, wherein the multiphase powder is relatively soft and thus has good cold-compactability, microstructure, heat treatment response, controllable flow, and also results in a homogenous, near full density product after sintering.

SUMMARY OF THE INVENTION

The present invention provides a mechanical alloying method utilizing a dry milling process to produce metal powders, such as those used in the manufacture of steels, wherein the shortcomings mentioned above may be avoided. More specifically, the present invention provides a method for producing a metal powder, such as a steel powder, for the production of tool steels and high alloy steels, which method results in a powder having good cold-compactability, homogeneity, and which method is more cost effective than atomization and other known methods.

One type of dry milling, suited particularly well for the method of the present invention, is termed "solid state micro-blending" (SSM). The process of solid state micro-blending is essentially a dry milling procedure related to mechanical alloying, whereby ductile phases and more brittle addition agents, or phases, are dry milled together in a ball mill, preferably a high energy ball mill. The milling performed in solid state micro-blending is similar to the milling done for mechanical alloying, but the milling time is substantially reduced. In solid state micro-blending, the ductile phases and the more brittle phases are milled for a period of time which is just sufficient to allow some dispersion and embedding of the brittle phases within the ductile phases, yet without encountering excessive solid solution hardening. This process results in a mixture that is neither alloyed as a solid solution, as would result if substantial mechanical alloying occurred, nor is excessively hardened beyond the point that simple annealing will not allow substantial ductility recovery in the ductile matrix components. This method is advantageous in that expensive vacuum refining and milling times of 48 hours and more are not required. The dry milling method termed solid state micro-blending, adopted herein for high alloyed steels, has been used previously for applications in low alloyed and medium alloyed steels, and is described in greater detail, including an annealing step, in U.S. Pat. No. 4,799,955, which annealing step is a process in which the milled product is heated to a temperature of between about 500° C. to about 1000° C. for a period of between about 8 hours to about 5 minutes in an inert atmosphere. The length of this annealing step is inversely proportional to the annealing temperature.

The powders produced by solid state micro-blending (SSM), when viewed under an optical microscope, readily show small particles of the more brittle phases embedded in and largely surrounded by ductile phases. In other words, the multiphase powders produced by solid state micro-blending consist of discrete alloying components mechanically incorporated into a soft iron matrix. Simply worded, in layman's terms, solid state micro-blending is like "pushing marbles into butter". After an annealing step to soften the powder, some type of compacting of the powder, such as die pressing or cold isostatic pressing, is performed, followed by high temperature treatment. This process forms the final micro-structure by diffusion, thus yielding the desired mechanical properties of the alloy. Thus, in solid state micro-blending, the actual alloying of the material does not take place until the final heat treatment.

In contrast to powders produced by solid state micro-blending, mechanically alloyed powders are typically milled to a fine powder, having an essentially featureless structure when viewed optically. In this state, wherein near saturation hardness is achieved, substantial ductility recovery, by a simple annealing step to a state comparable to that of the unalloyed ductile components, is impossible.

The present invention is a method for using the solid state micro-blending procedure described above to produce metal powders, such as for high alloy steels, including high speed tool steels. High speed steels are typically complex alloys that usually contain, in addition to iron and carbon, at least four essential alloying elements, i.e. molybdenum, tungsten, vanadium, and chromium; certain high speed steels may also contain cobalt. These alloys are most frequently used in cutting, tooling, and wear applications, where advantage may be taken of their ability to be hardened to the Rockwell C 60 to 70 range by heat treatment, and of their capability to retain this hardness even after exposure to temperatures of the order of 500° C. to 600° C.

Despite their complexity, such multi-component alloys are found to be ideally suited for the production of powder via the solid state micro-blending process. For example, powder for high speed steel is just one example of a powder which may be ideally suited for the solid state micro-blending process. High speed steels in the annealed state typically contain 20 to 30 weight percent of carbides distributed in a relatively "unalloyed" ferritic matrix. With the possible exception of chromium, and cobalt if present, an exceedingly high proportion of the remaining major alloying components, i.e. tungsten, molybdenum, and vanadium, are partitioned in annealed steels to the carbide phase. According to Kayser and Cohen, "Metal Progress" Volume 61, No. 6, p.348, 1952, the carbide partitioning in classical high speed steels amounts to nearly 95% of the combined tungsten and molybdenum, 85% to 95% of the vanadium, and to about 50% of the chromium.

These complex carbides, all containing iron in addition to the strong carbide forming elements mentioned above, are of a brittle nature, and hence should be readily dispersible. Moreover, the characteristic diameters of carbides in conventional high speed steels are usually in the range of 1 to 10 micrometers, and matrix phase grain diameters are of the order of 5 to 50 micrometers. This is in marked contrast to the classical mechanical alloyed oxide dispersed systems, where oxide particles of nanometer scale dimensions are distributed in matrices with grain diameters of 1 to 100 nanometers. Therefore, both the nature of the critical alloying ingredients, i.e. brittle carbides, and the micrometer scale of their dispersion, are characteristics which are favorable for the solid state micro-blending processing of high alloy and high speed steels of the present invention.

The use of metal carbides and oxides for the addition of alloying elements to mechanically alloyed powders is known. Some examples can be found in U.S. Pat. Nos. 3,591,349, 3,623,849, and 3,785,801 all issued to Benjamin, and U.S. Pat. No. 4,443,249 issued to Weber. Similarly, additions of powdered elemental carbon as a carbon source to metal powders are common. The compositions of most tool steel alloys, however, are such that the required alloying components generally cannot be provided solely in the form of metal carbides. The reason for this is that commercially available stoichiometric alloy carbides are excessively rich in carbon. The blending of these alloy carbides with iron powder in order to produce a desired alloy tool steel, wherein the metallic components are in proper proportion, generally results in an alloy having an excessive carbon content. Therefore, a portion of the alloying additions must be made in the form of low carbon metallic powders. Occasionally, additions of elemental carbon must also be made for adjustment of the final composition.

The novelty and challenge of the method of the present invention arises, however, in trying to find a suitable combination of elements and compounds thereof, those which simultaneously satisfy not only the compositional requirements of the final alloy, and can be used with the solid state micro-blending process, but which also yield powders with useful characteristics such as flow, compressibility and good sintering response. Specifically, solid state micro-blending has been found to be particularly sensitive to the type of alloying materials used. For example, while the use of ferrovanadium as a vanadium source is reported to be successful in mechanical alloying, repeated tests show that the use of ferrovanadium as a vanadium source is unsuccessful when utilizing the short milling times of solid state micro-blending. It is believed that this may be due to the high temperature diffusion process that must be employed to finally form the chosen micro-structure by reaction and diffusion of the alloying components. In the powders produced by solid state micro-blending, alloying particles can be readily distinguished within the powder, even at low magnifications with an optical microscope, thus indicating fairly long diffusion distances wherein the proper alloys which will diffuse these distances must be found.

To summarize up to this point, the method of solid state micro-blending is characterized by several distinct advantages over other known methods of powder production. Further, because of the advantages, it would be desirable to apply the solid state micro-blending method to high alloy steel powders. However, high alloy steel powders typically require the addition of alloying elements via metal carbides and oxides, and the method of solid state micro-blending is particularly sensitive to the types of alloying materials used. In other words, alloying sources, which work successfully with other methods of mechanical alloying, work unsuccessfully with the method of solid state micro-blending. The present invention arrives at a method wherein solid state micro-blending can be used successfully in the production of high alloy, high speed steel powders, although not limited to only high alloy and high speed steel powders.

In one embodiment, the method of the present invention entails processing by solid state micro-blending a base iron powder with the alloying additions where substantially all of the vanadium content for the alloy is added as vanadium carbide with the remaining additions as metallics and carbides or, if desired, nonmetallics such as alumina. By utilizing the discoveries disclosed herein, a useful powdered alloy was obtained using solid state micro-blending.

When producing steel powders by solid state micro-blending, the selection of the form of carbon addition is also critical. In addition, if metal carbides and oxides are used, the type of metal carbides and the pre-treatment of the additions, including oxides, is also critical. Although the use of ferrovanadium and elemental carbon are reported to be satisfactory in mechanical alloying, as discussed in U.S. Pat. No. 3,591,349, the process of solid state micro-blending was not found to tolerate these additives. Without the proper selection of alloys, useful micro-structures and the sintered density expected in such alloys, optionally including alumina, are not obtained when utilizing solid state micro-blending.

Without pre-treatment to remove free carbon and oxides, commercially available carbides, such as vanadium carbide, and other metal powders, presumably due to impurities, may be unsatisfactory for use with the present invention. More specifically, though not fully understood at this time, it is believed that any free carbon or free graphite in the powder mixture may have a lubricating effect wherein the powder may not be alloyed, and may further result in a powder which is too fine and therefore non-flowable. The method of the present invention yields a high alloy, flowable sintering powder.

One preferred method of pre-treatment is to mix powdered, commercial vanadium carbide with other powdered metallic additions including carbon powders, if needed, and to heat the mixture, for a period of time, in a vacuum near 1100 degrees centigrade. A vacuum, or the use of an inert atmosphere, such as argon, is necessary in order to remove oxygen from the alloying components and also to permit reaction with alloying components of any free carbon preexisting in the additive or intentionally added to the mixture. This mixture of powders, after pretreatment and cooling, is found to be useful and successful when the method of solid state micro-blending as described herein is employed.

Attempts, using other methods, may have been made to use elemental powder mixtures, such as iron and elements from Group VI of the periodic table (ie. chromium, molybdenum, and tungsten) with either graphite or other carburized powders, but are anticipated to yield unsatisfactory results. During sintering of these powders, it is predicted that swelling of the powder compact may occur due to transient liquid phase formation and penetration of this liquid into surrounding inner particle regions of the iron powder. This is believed to leave a void at the original location of the alloying additive and appears, especially in the case of molybdenum and chromium, to cause swelling by penetration of the original Fe-Fe (matrix phase) powder pressing contacts. Due to this swelling, proper densification is unobtainable.

The method of the present invention, which utilizes solid state micro-blending of pretreated alloying additives, results in a powder mixture of elements which may be successfully sintered without swelling of the powder compacts, and wherein near full compaction (ie. 98% or greater) of the powder, and near full densification (ie. 98% or greater) of the final product may be attained. This is believed to be due to the fact that penetration of liquid phase formed by low-melting eutectics has only limited access to the original iron particle contact boundaries. Also, the duration of transient liquid phase is greatly minimized because of more rapid homogenization of solid state micro-blended powders.

It has also been found, with the method of the present invention, that if a substantial addition of free carbon to the powder, prepared as above, is necessary to obtain the final composition, upon pressing and sintering to produce the final alloy part, lower final densities result than when metal carbides are used as carbon additions in the above milling process.

BRIEF DESCRIPTION OF THE DRAWINGS

The invention may be more fully understood with reference to the accompanying drawings, wherein:

FIG. 2*a* is a scanning electron microscope (SEM) image of M2 powder, in as-milled condition, prepared by solid state micro-blending;

FIG. 2*b* is an SEM image of typical water-atomized high speed steel powder;

FIG. 3 is a photomicrograph showing the microstructure of M2 powder, in unetched condition, wherein $Al_2O_3$ dispersion is shown;

FIG. 4 is a photomicrograph showing the microstructure of M42, in etched condition, wherein alloy dispersion with lamellar structure is shown;

FIG. 5*a* is a photomicrograph of M2 showing $Al_2O_3$ dispersion in a heat treated compact;

FIG. 5*b* is a photomicrograph of M2 showing carbide dispersion in a heat treated compact;

FIG. 6 is a photomicrograph of M2 showing carbide dispersion in a heat treated compact;

FIG. 7 shows the microstructure of an solid state micro-blended T15 alloy after vacuum sintering at 1270° C, but prior to annealing;

FIG. 9*a* is a photomicrograph showing large carbides in a non-powder metallurgy reference wear-test sample;

FIG. 9*b* is a photomicrograph of solid state micro-blended T15 showing carbide dispersion in a heat treated compact;

FIG. 10 is a photomicrograph of a high speed steel powder compact after sintering and heat treatment; and FIG. 11 is a photomicrograph of a high speed steel powder compact with dispersed $Al_2O_3$ after sintering.

DESCRIPTION OF THE PREFERRED EMBODIMENTS

Figure 1:
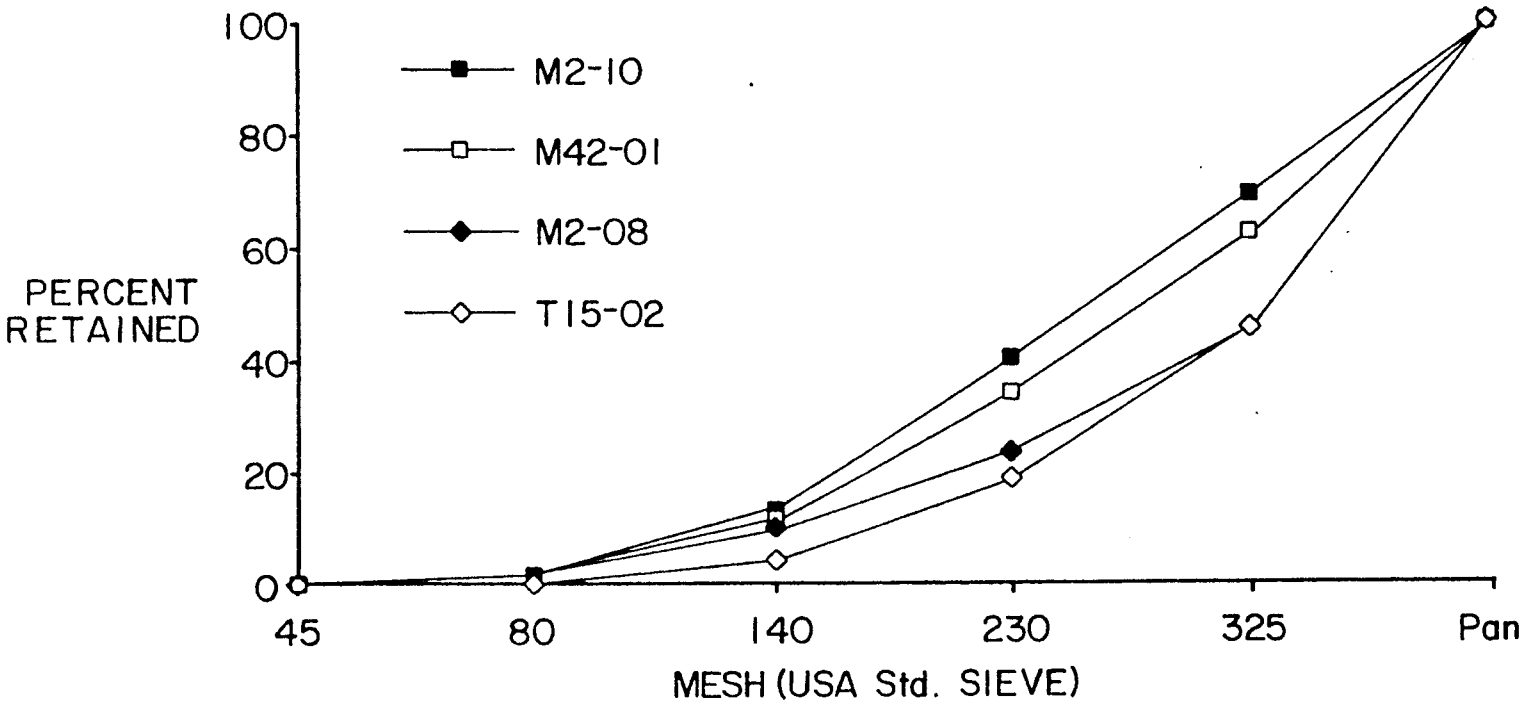
FIG. 1 is a screen analysis of as-milled M2, M42, and T15 powders.

Several alloys were prepared utilizing the method of the present invention, wherein alloys are pretreated, solid state micro-blended with iron powder, and sintered. The alloys prepared by this method, which are examples and do not limit the scope of the invention, will be discussed further under the following subheadings; 1. Alloy Preparation and Milling, 2. Powder Characterization, 3. Compaction, Sintering, and Consolidation, 4. Heat Treatment, 5. Microstructure of Heat Treated Solid State Micro-blended (SSM) Alloys, 6. Heat Treatment Response and Blend-Test Properties, and 7. Abrasive Wear Resistance.

It will be appreciated that those skilled in the art of metal and steel production are familiar with industry standards. Several standard types of steel, used for the examples discussed hereinbelow, are M2, M42, and T15, which standards have been established by the American Iron and Steel Institute (AISI). Thus, the alloys prepared contain the industry standard M2 high speed steel, two M2 variations containing dispersions of 3 and 5 weight percent $Al_2O_3$, and two cobalt bearing steels, T15 and M42. These alloys provide a representative cross section of alloy compositions, including molybdenum-tungsten types (M2), tungsten-vanadium-cobalt types (T15), or molybdenum-cobalt types (M42). It will further be appreciated that the following notation will be used in discussing specific examples: each sample has been given a label, wherein the first portion of the label denotes the type of steel, in accordance with industry standards, and the second portion denotes the lot number used for identification during preparation. Thus, sample M2-08 is type M2 steel having lot number 08.

Alloy Preparation and Milling: The starting raw materials of these preparations consist of commercially available water atomized iron powder screened to −100 mesh, as well as various alloying components which can be obtained either commercially or by special production. It will be appreciated that it is unnecessary to match the exact stoichiometry of the individual equilibrium carbides as they are known to exist in the given steel, and that the various components may be prepared so that the components, in mixture, match the desired alloy composition. Cobalt in the T15 and M42 grades was supplied in the form of commercially available metallic powder with starting particle size on the order of 3 micrometers. The $Al_2O_3$ used in two of the M2 base alloys (M2-08 and M2-09) was commercially obtained high purity material with mean particle size, prior to milling to 3 and 6 micrometers, respectively. Milling of these preparations, detailed below in Table 1, was done under an inert gas atmosphere, ie. argon, in a pilot-scale ball-mill with a typical powder batch size of about 50 pounds.

TABLE I

Aim Chemical Compositions (Wt. %) of SSM High Speed Steel Alloys

| ALLOY-LOT | W | Mo | V | Cr | Co | A12O3 | C |
|---|---|---|---|---|---|---|---|
| M2-08 | 5.8 | 4.85 | 1.94 | 3.88 | — | 3.0 | 1.00 |
| M2-09 | 5.7 | 4.75 | 1.90 | 3.80 | — | 5.0 | 1.00 |
| M2-10 | 6.0 | 5.0 | 2.0 | 4.0 | — | — | 1.00 |
| M42-01 | 1.6 | 9.5 | 1.2 | 3.75 | 8.0 | — | 1.15 |
| T15-01 | 12.0 | 1.0 | 5.0 | 4.25 | 5.0 | — | 1.65 |
| T15-02 | 12.5 | — | 5.0 | 4.50 | 5.0 | — | 1.65 |

Powder Characterization: The following section discusses the powder characterization of some samples prepared by the method of the present invention. The results and examples disclosed hereinbelow do not limit the scope of the invention. The cumulative sieve analyses for several of the powders whose compositions are shown in Table I are presented in FIG. 1. The seive analysis for M2-09 (5% $Al_2O_3$) is similar to that of M2-08 (3% $Al_2O_3$), and that of T15-01 is similar to that of T15-02.

Although the milling time for each of these alloys was similar, the alumina-containing powders as well as the T15 alloys were appreciably finer than either the M2 (without alumina) or the M42. For example, about 55% of both the T15 and the alumina-containing M2 powders are finer than 325 mesh, whereas only 30% of the M2 without alumina, and about 37% of the M42, are finer than 325 mesh.

A scanning electron microscope (SEM) image of the M2-10 powder is shown in FIG. 2*a*. The layered "potato shape" of these particles can be contrasted with the highly irregular shape typical of a water-atomized high speed steel powder such as that shown in FIG. 2*b*.

The microstructure of polished cross sections of as-milled powder can be seen in FIGS. 3 and 4. In the unetched condition, illustrated in FIG. 3, the $Al_2O_3$ dispersion in M2-09 is shown. FIG. 4 illustrates the M42 powder, in the etched condition, where the lamellar structure (discussed by Benjamin in "New Materials by Mechanical Alloying Techniques" Ed. E. Arzt and L. Schultz, Deutsche Gesellschaft ffir Metalkunde e. V., Oberursel, Deutschland, 1989), which is characteristic of an earlier stage in mechanical alloying, may be seen. When longer milling times are employed, the lamellar structure will generally disappear. In other words, when longer milling times are used, the powder will eventually exhibit, at least in standard light microscopy, a featureless microstructure. However, it is an aim of the present invention to achieve an alloy distribution with mean inter-particle distance on a micrometer scale, as opposed to a nanometer scale, wherein no attempt was made to approach a microstructurally featureless state under normal light microscope resolution.

The apparent density and Hall Flow of solid state microblended M2, with and without $Al_2O_3$, as well as solid state microblended T15 is presented in Table II. The apparent densities of these alloys are higher than those of water-atomized high speed steel powders, which are typically in the range of 2.2 g/cm to 2.5 g/cm and less than that of typical spherical gas atomized powders. These results are to be expected in view of the shape of these powders as described above. The Hall Flow of both the solid state microblended M2 and T15 alloys are comparable with those of the faster flowing water-atomized high speed steel powders.

TABLE II

Apparent Density and Hall Flow of SSM Powders

| Alloy | Apparent Density (g/cm | Hall Flow (sec/50 g) |
|---|---|---|
| M2-10 | 3.03 | 24 |
| M2-09 (5% $Al_2O_3$) | 2.95 | Intermittent |
| T15-01 | 3.04 | 40 |

Compaction, Sintering and Consolidation: Powder samples were die compacted at 50 tsi (690 MPa) in a single action press into bar-shaped samples with nominal dimensions of 7.5 cm×1 cm×1 cm. These samples were eventually used for density measurements, and for evaluation of blend-strength, hardness, and abrasive wear properties. Lubrication, other than for the die wall, was not used. The samples were further found to have adequate handling strength.

The green powder compacts were deoxidized during vacuum sintering by heating to 1100° C. holding for 15 minutes, raising the temperature to 1150° C. and again holding for a 15 minute period. The samples were then heated to the final sintering temperatures and were sintered for 30 to 45 minutes at that temperature.

Although typically not necessary, it is sometimes desirable to use a secondary consolidation process when full densification of the final product is required. Generally, the manufacture of pressed parts, such as machine parts or tools, does not mandate a secondary consolidation process, and further, it should be emphasized that such a process is not required for powders produced by the method of the present invention. However, it may be of interest to consider the use of a secondary consolidation process in conjunction with the method of high alloy powder production disclosed herein.

Types of secondary consolidation processes include forging, Ceracon processing, and hot isostatic pressing, among others. Ceracon processing is further discussed in Metals Handbook, 9th Ed., "Powder Metallurgy", Vol. 7, p. 537-541, ASM, Metals Park, OH, 1984. This process was chosen here, instead of hot isostatic pressing (HIP) because it would be unnecessary with Ceracon processing to encapsulate the samples in the event that interconnected porosity were present.

Those samples which were to receive a post vacuum sintering consolidation treatment were die compacted as above, but heated to a final sintering temperature well below the temperature at which full density could be achieved. The idea with these samples was to avoid liquid phase formation and otherwise to avoid temperatures where appreciable coarsening of carbides would occur Below is Table III presenting the density data obtained on the sintered samples in which final densification was achieved using secondary consolidation processing. The data presented in Table III includes the weight percent of $Al_2O_3$, the sintered temperature in degrees celsius, the Green density and Ceracon density expressed in grams per cubic centimeter, and the percent of theoretical density.

TABLE III

Densities of High Speed Steel After Cold-Compaction of Solid State Microblended Powders, and Secondary Ceracon Consolidation

| Alloy-Lot | $Al_2O_3$ Weight % | Sinter Temp °C. | Green Density | Ceracon Density | Percent of Theo. Density |
|---|---|---|---|---|---|
| M2-08 | 3 | 1200 | 5.74 | 7.74 | 98.6 |
| M2-08 | 3 | 1200 | 5.74 | 7.75 | 98.7 |
| M2-08 | 3 | 1200 | 5.74 | 7.80 | 99.4 |
| M2-08 | | 1200 | 5.73 | 7.68 | 97.8 |
| M2-09 | 5 | 1200 | 5.63 | 7.66 | 99.6 |
| M2-09 | 5 | 1200 | 5.61 | 7.68 | 99.9 |
| M2-09 | 5 | 1200 | 5.63 | 7.65 | 99.5 |
| M2-09 | 5 | 1200 | 5.84 | 7.66 | 99.6 |
| M2-10 | — | 1200 | 5.98 | 8.08 | 99.8 |
| M2-10 | — | 1200 | 6.26 | 8.04 | 99.3 |
| M42-01 | — | 1180 | 5.86 | 7.92 | 100 |
| M42-01 | — | 1180 | 6.12 | 7.90 | 99.7 |
| T15-01 | — | 1230 | 6.07 | 8.20 | 100 |
| T15-01 | — | 1230 | 6.27 | 8.20 | 100 |
| T15-02 | — | 1230 | 6.14 | 8.26 | 100.1 |
| T15-02 | — | 1230 | 6.28 | 8.25 | 100 |

Heat Treatment of Test-Bar Compacts: All test bars were annealed after sintering and Ceracon compaction by reheating to 900° C. in a vacuum furnace. After holding for about 2 hours at the annealing temperature, the samples were slowly cooled through the critical range. The steels were then hardened utilizing standard salt bath austenitizing, quenching, and tempering treatments. The temperatures employed in these heat treatments are summarized in Table IV. These test bars were subsequently used for microstructural evaluation, bend-tests, hardness measurements, and wear tests.

TABLE IV

Heat Treatment of SSM High Speed Steel Alloys

| Alloy | Austenitizing Temp. F. | (C.) | Tempering Temp. F. | (C.) | Tempering Time Hours |
|---|---|---|---|---|---|
| M2 (all lots) | 2200 | 1204 | 1000 | 538 | 3 + 3 |
| M42 | 2175 | 1190 | 1000 | 538 | 3 + 3 + 3 + 3 |
| T15 | 2250 | 1232 | 1000 | 538 | 3 + 3 + 3 |

Microstructure of Heat-Treated SSM Alloys: Microstructure of the heat-treated compacts are shown in FIGS. 5, 6, and 7. An example of an alumina-containing M2 alloy is seen in FIG. 5. FIG. 5*a* illustrates the $Al_2O_3$ distribution, and FIG. 5*b* illustrates the complimentary carbide distribution. As illustrated, the largest oxide particles appear to be about 3 micrometers in diameter, and an appreciable fraction of particles are in the range of 0.5 to 1 micrometer.

The carbides shown in FIGS. 5*b* (M2 with $Al_2O_3$), and in FIG. 6 (M2 oxide-free) are generally in the range of 1 to 3 micrometers and are fairly uniformly distributed.

FIG. 7 shows an example of the microstructure of a solid state microblended T15 alloy after vacuum sintering at 1270° C., but prior to annealing. This sintering temperature is higher than that employed on samples that were later Ceracon consolidated. The grain boundaries are quite evident in this sample because of the dark-etching carbide precipitation which formed at the boundaries during cooling from the sintering operation. The largest grain diameters in this sample appear to be about 30 micrometers, an estimate in general agreement with the well known Zener (C. Zener, as quoted by C.S. Smith, Tran. AIME, Vol. 175, p. 15, 1948) expression for the maximum grain size, $D_{max}$, in an alloy containing stable dispersoids:

$$D_{max}=4r/3f$$

Here, r is the dispersoid radius and f the volume fraction. According to Kayser and Cohen ("Metal Progress" ), the volume fraction of carbides for T15 austenitized at hardening temperatures near 1230° C. is about 0.12. In consideration of the higher sintering temperature, and thus more dissolved carbides, in the samples discussed herein, let f=0.1 and r=2 micrometers. Calculations yield a maximum grain diameter=26 micrometers. In similar fashion, an estimate, based on the Zener equation, yields a maximum grain size of about 6 micrometers in M2-08, an alloy with added alumina dispersoids. This is in good agreement with metallographic observations of vacuum sintered samples.

Heat Treatment Response and Bend-Test Properties: Bend-test specimens with base dimensions of 6.3 millimeters and height of 8.9 millimeters were ground from the heat-treated test-bar compacts. The samples were tested in 4-point loading with top and bottom load spans of 14 and 38 millimeters, respectively, These samples were also used to evaluate the heat treatment response of the alloys as measured by Rockwell C hardness. Data for bend-test and hardness measurements are presented in Table V.

TABLE V

Bend Strength and Rockwell C Hardness (Average of 4 samples for M2-08 and M2-09 and 2 samples for M2-10, M42, and T15)

| Alloy-Lot No. | Bend Rupture (ksi) | Stress (MPa) | Hardness (Rockwell C) |
|---|---|---|---|
| M2-08 | 244 | 1680 | 65.5 |
| M2-09 | 255 | 1755 | 66.0 |
| M2-10 | 300 | 2065 | 65.5 |
| M42-01 | 280 | 1925 | 65.0 |
| T15-01 | 235 | 1615 | 68.0 |
| T15-02 | 216 | 1485 | 68.2 |

The hardness levels achieved in the M2 and T15 alloys are characteristic, for the given heat treatments, of high speed steels with excellent heat-treatment response. The hardness level of M42 may be slightly below what one would expect, wherein this may possibly be due to the higher than optimal final carbon content of this alloy.

These data show that nominal bend strengths were in the range of 2050 MPa for alumina-free M2, to 1500 Mpa for T15, values comparable, with due consideration of the hardness of these samples, to those achieved in properly vacuumed sintered high speed steel.

The above mentioned hardness and bend strength properties may be further improved if tempering cycle and other processing variables are optimized. These processes (further discussed in Beiss, Wahling, and Duda, "Modern Developments in Powder Metallurgy" MPIF/APMI, Princeton, NJ, 1985) include factors such as annealing cycle, and vacuum sintering soaking temperatures in regard to achievement of good bend rupture strength. It will also be appreciated that it is of critical importance to maintain fine carbide size and to avoid even minor levels of porosity.

Abrasive Wear Resistance: Laboratory wear tests to provide data in support of abrasive wear applications have been categorized as tests of low-stress abrasion, high-stress abrasion, and gouging abrasion, as discussed by D.L. Albright and D.J. Dunn, "Journal of Metals" Vol. 35, No. 11, p 23-29, 1983. Many applications such as those frequently encountered in the mining industry have high-stress abrasion as the primary mode of abrasive wear. Moreover, it is widely agreed that the laboratory pin, or pin-on-disk test provides reasonable correlation with material behavior under conditions of high-stress wear.

Previous studies (R.J. Beltz, J.D. Dankoff, and R.A. Queeney, "Progress in Powder Metallurgy", Ed. H.I. Sanderow, W.L. Giebelhausen, K.M. Kulkarni, Vol. 41, p. 235-250, Metal Powder Industries Federation, Princeton. N.J., 1985; R.A. Quenney, R.E. Masters, R.J. Beltz, and J.D. Dankoff, "Modern Developments in Powder Metallurgy", Ed. P. Ulf Gummeson, D.A. Gustafson, Vol. 20, p. 409-419, MPIF, Princeton, NJ, 1988; R.J. Beltz, J.D. Dankoff, R.J. Henry, and R.V. Ramon, "Advances in Powder Metallurgy-1991", Vol. 6, p. 177-189, MPIF/APMI, Princeton, NJ, 1991) have shown that aluminum oxide additions to high speed steels can result in significant increases in both abrasive and adhesive wear resistance. Wear resistance of the solid state microblended high speed steels discussed herein were measured by means of pin abrasion test originally developed by Muscara and Sinnott ("Metals Engineering Quarterly", Vol. 12, p. 21-32, 1972). Actual testing was conducted on a modified test apparatus at Climax Research Services Corporation (CRS) using 0.25" diameter cylindrical pins cut from broken bend test samples using wire EDM machining.

In each test, the pin specimen was pressed under a load of 15 pounds against a standard abrasive cloth comprised of 150 mesh garnet. The abrasive cloth is attached to a movable table, and the test specimen moves back and forth in a non-overlapping pattern across fresh abrasive. As it travels, the specimen rotates at 22 rpm and travels a linear distance of approximately 500 inches. After each test the specimen is weighed to determine weight loss. The test is then repeated using fresh abrasive cloth and the average weight loss is determined.

Figure 8:
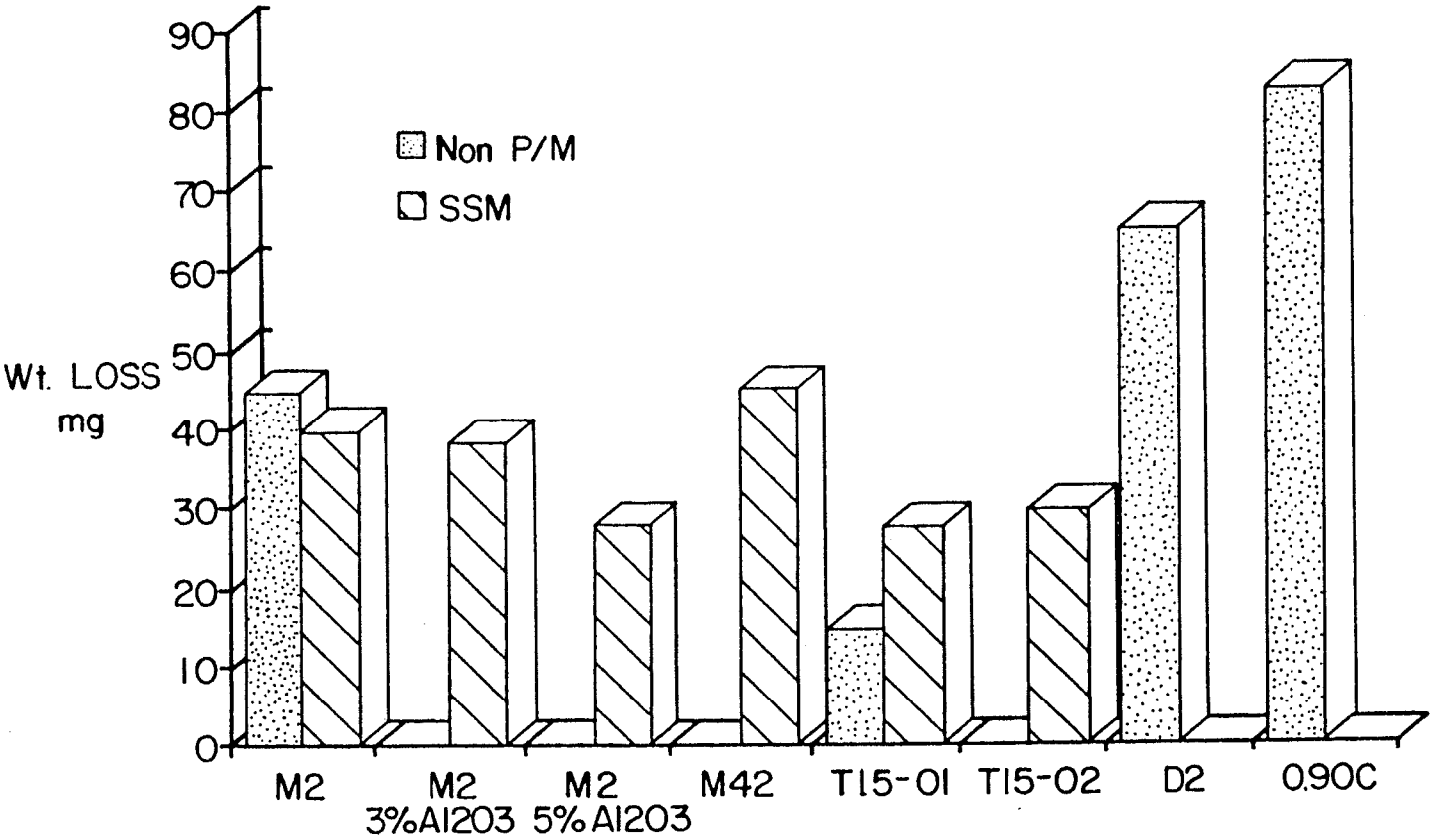
FIG. 8 illustrates results of a pin abrasion test in solid state micro-blended steels and in non-powder metallurgy reference alloys.

As reference standards, several non powder-metallurgy steels were tested. They included heat-treated wrought M2 and T15 high speed steel, and D2 die steel, all obtained from a specialty steel manufacturer, and two heat-treated low alloy martensitic reference standards of widely differing carbon contents, alloys routinely used by CRS as standards in all pin-test wear studies. These were a 0.90% C quenched and tempered drill rod and a 0.19% C., 0.5% Cr, 0.25% Mo, martensitic alloy. Results are presented in tabular form in Table VI and are graphically illustrated in FIG. 8. Results for the low carbon martensitic alloy, though presented in Table VI, are omitted in FIG. 8 for sake of clarity.

TABLE VI

Pin Abrasion Test Results Showing SSM High Speed Steels in Comparison with Various Non-Powder-Metallurgy Reference Steels

| SSM Alloys | Alumina Wt. % | Hardness Rock C | Wt. Loss Test 1 (mg) | Wt. Loss Test 2 (mg) | Wt. Loss Average (mg) |
|---|---|---|---|---|---|
| M2-10 | — | 65.5 | 40.1 | 39.4 | 39.8 |
| M2-08 | 3 | 65.5 | 38.9 | 37.8 | 38.4 |
| M2-09 | 5 | 66.0 | 28.3 | 27.6 | 27.9 |
| M42 | — | 65.0 | 45.5 | 44.9 | 45.2 |
| T15-01 | — | 68.0 | 27.8 | 27.5 | 27.7 |
| T15-02 | — | 68.2 | 29.8 | 30.3 | 30.1 |
| Non P/M Alloys | | | | | |
| M2 | — | 66.3 | 45.1 | 44.3 | 44.7 |
| D2 | — | 54.6 | 65.5 | 64.6 | 65.1 |
| T15 | — | 68.1 | 14.4 | 15.1 | 14.7 |
| 0.90C | — | 61.0 | | | 82.9 |
| 0.19C | — | 269 Brinell | | | 143.3 |

It will be appreciated that the solid state microblended alloys without dispersed alumina yield wear results which are exactly as expected, based on a model of increasing wear resistance with increasing vanadium content. Among high speed steels widely used, T15, with nominal 5% vanadium, is generally considered to have the highest wear resistance.

It will further be appreciated that the alumina dispersed M2 base steel alloys prepared by solid state microblending show increased wear resistance. Further, as shown above in Table VI, M2-09, with 5% $Al_2O_3$, has approximately the same wear resistance as the solid state microblended T15 alloys, but lower resistance than that of the non powder metallurgy T15 reference steel. However, a recent study ("Advances in Powder Metallurgy-1991") indicates that the adhesive or sliding wear properties of a solid state microblended M2 base alloy with 5% $Al_2O_3$ are clearly superior than that of a non powder metallurgy T15 alloy.

Differences between adhesive versus abrasive wear behavior may be due to the size of dispersed wear particles, either carbide or alumina particles. For example, FIG. 9*a* shows the carbides in the non powder metallurgy T15 which are very large in comparison with the carbides of the solid state microblended T15 of FIG. 9*b*. Thus, the large carbides of FIG. 9*a* may be advantageous in terms of high-stress mode abrasive wear behavior. However, powder metallurgy high speed steels, in comparison to conventional wrought alloys, exhibit superior grindability. The importance of grindability versus abrasive wear resistance is dependent upon the application.

The present invention may be better understood by the following examples of preferred embodiments, where high speed tool steels of the designation M-2 are the desired final product. The compositions of M-2 typically contains 6% tungsten, 5% molybdenum, 2% vanadium, 4% chromium, 1% carbon, with the balance iron. To promote sintering, small quantities of ferrophosphorus may also be added.

In one embodiment, a thorough mix of 443 grams of commercial vanadium carbide powder (manufactured by Shieldalloy, lot no. 58241), 917 grams of molybdenum powder (type 490 manufactured by GTE Sylvania, lot no. MO773T), and 1101 grams of tungsten powder (type M17 manufactured by GTE Sylvania, lot no. WA17165C) are thoroughly mixed with 74 grams of graphite powder (type 1651 manufactured by Southwest) and heated under vacuum for 2.5 hours at 1100 degrees centigrade.

This powder, produced as disclosed above, is then mixed with 1090 grams of commercial high carbon ferrochromium powder (such as "High Carbon Ferrochromium" manufactured by Shieldalloy, lot no. 10179-69, or "High Carbon Ferrochromium" manufactured by Elkem Metals, lot no. 8358), 115 grams of commercial ferrophosphorus (manufactured by FMC Corporation, lot no. 004837), and co-milled, for sizing purposes, for 1 hour in a four foot diameter gravity dependent ball mill containing 710 pounds of 3/16 inch steel balls, under an argon atmosphere at 35 to 37.5 rpm. A total of 14,454 grams of iron powder ("Atomet 1001" manufactured by Quebec Metal Powders, lot no. 51429) is added, and milling resumes under an argon atmosphere for a total of 20 hours.

As illustrated in FIG. 10, the resultant powder is sized near that of the original iron powder fed, and after annealing, is pressed and vacuum sintered. The resultant sample is generally found to have a density above 98% of full density and a micro-structure typical of high speed tool steel. Other unique steel alloy powders may also be produced by the method disclosed in this embodiment.

In another embodiment of the present invention, alumina is pre-treated with ferrochromium prior to solid state micro-blending to produce an alumina-containing tool steel using the method disclosed in the above embodiment.

If plain, untreated alumina is added to tool steel made as in the method of the above disclosed embodiment, poor sintering, as well as poor bonding with the metallic phase, may result. To overcome this deficiency, the procedure of the following embodiment may by employed. A total of 352 grams of minus 325 mesh alumina (type 7311, manufactured by Norton Company/Alundum, lot no. Sample B Tomblom) is mixed with 35 grams of commercial ferrochromium (same as the above embodiment) and heated in vacuum at 1093 degrees centigrade for 2 hours. The final powders are prepared by the method disclosed in the above preferred embodiment. The four foot diameter ball mill containing 710 pounds of 3/16 inch steel balls is charged with 1578 grams of pretreated alloys, as disclosed in the above preferred embodiment. Milling under an argon atmosphere at 35 to 37.5 rpm. continues for 1 hour to reduce the particle size. The mill is then opened and 9031 grams of commercial iron powder (same as the above embodiment) is added along with the alumina previously treated. After evacuation and sealing, the mill is operated at 35 to 37 rpm under an argon atmosphere for 16 hours. Annealing, pressing, and vacuum sintering at 1240 degrees celsius of the produced powder results in a dense, satisfactory micro-structure with good metallic bonding, and is shown in FIG. 11.

In summary, one feature of the invention resides broadly in a method of producing carbon containing steel alloy powders by a dry milling process whereby substantially all of the alloy content, particularly cobalt, tungsten, molybdenum, is added as elemental powders, carbided elemental powders or mixtures thereof.

Another feature of the invention resides broadly in a method of producing carbon containing steel powders by solid state micro-blending whereby substantially all of the alloy content, particularly cobalt, tungsten, molybdenum, is added as elemental powders, carbided elemental powders, or mixtures thereof.

Yet another feature of the invention resides broadly in a method of producing vanadium and carbon containing steel alloy powders by a dry milling process whereby substantially all of the vanadium content is added as powdered carbide and other alloys, if desired, can be added as powdered alloys or partially carbided powders.

A further feature of the invention resides broadly in a method of producing vanadium and carbon containing steel powders by solid state micro-blending whereby substantially all of the vanadium content is added as a carbide and other alloys, if desired, can be added as alloys or partially carbided powders.

Another feature of the invention resides broadly in a process to utilize commercially available vanadium-carbon alloys or carbides, whereby a mixture of this and other powdered alloys, carbon powder, if needed, and metals are mixed and subject to heating near 1100 degrees Centigrade, preferably in a vacuum or dilute inert atmosphere, such that all powders are subject to this temperature and cooling under inert conditions then used in dry milling or solid state micro-blending powder production process.

Yet another feature of the invention resides broadly in a method of producing vanadium and carbon containing tool steel alloy powders by a dry milling process whereby substantially all of the vanadium content is added as a powdered carbide and other alloy additions can be added as powdered alloys including carbide powders or partially carbided powders.

Still another feature of the invention resides broadly in a method of producing a tool steel powder containing alumina which sinters to high densities using a dry milling or solid state micro-blending powder production process whereby powdered alumina is pretreated by mixing with fine ferrochromium and the mixture is subject to heating preferably in a vacuum or diluted inert atmospheres to at least 1000 degrees Centigrade and held for a period of time.

A further feature of the invention resides broadly in a method of producing a high alloy steel powder using dry milling or solid state micro-blending and suitable for powder metallurgical operations, said powder which will readily sinter to near maximum density wherein substantially all of the carbon needed to form the desired final composition is added as metal carbides and little or no carbon is added as a form of elemental carbon. The method being a micro-blending powder production process.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A method for making a high alloy metal composite powder from a base iron powder, a substance containing carbon in a combined form, and at least one alloying component, said method comprising the steps of:

a) pretreating, separately from said base iron powder, said at least one alloying component to substantially remove oxygen and substantially remove free-carbon from the at least one alloying component prior to milling said at least one alloying component, the free-carbon comprising carbon in a form other than a combined form; and b) milling, subsequent to said pretreating, said base iron powder, said substance containing carbon and said at least one pretreated alloying component for a period of time sufficient to embed said at least one pretreated alloying component in said base iron powder to produce an intermediate milled product.

2. The method according to claim 1, wherein said milling comprises solid state microblending, said carbon containing substance and said at least one alloying component comprise an alloying material and said method further comprises:

providing a substantial portion of the carbon of said alloying material as a carbide; and pretreating said alloying material by heating said alloying material in at least one of:

a vacuum, and an inert atmosphere, to remove oxygen from said alloying material and react free carbon in the alloying material.

3. The method according to claim 2, wherein said free carbon comprises at least one of:

elemental carbon, and graphite.

4. The method according to claim 3, wherein said pretreating comprises pretreating said alloying material to substantially remove all of the free carbon from the alloying material.

5. The method according to claim 4, wherein said pretreating comprises pretreating solely said alloying material to substantially remove the oxygen and substantially remove all of the free carbon from the alloying material.

6. The method according to claim 5, wherein the base iron powder has a compressibility, said at least one alloying component comprises: vanadium, tungsten, molybdenum and chromium, and said method further comprises:

providing at least some of the substantial portion of carbon as vanadium carbide;

providing a substantial portion of the vanadium as vanadium carbide;

providing each of the tungsten, the molybdenum and the chromium as one of:

A) a carbided alloying component;

B) a mixture of carbided alloying component and substantially carbon free alloying component, and C) substantially carbon free alloying component; and annealing said intermediate milled product to produce a metal composite powder having a compressibility similar to that of said base iron powder prior to milling.

7. A method of producing a steel alloy powder for the production of an alloyed end product, said steel alloy powder comprising a base iron, and at least a first alloying substance, at least a portion of said at least a first alloying substance comprising a carbide, said method comprising the steps of:

pretreating, separately from said base iron powder, said at least a first alloying substance to substantially remove oxygen and substantially remove free-carbon from said at least a first alloying substance prior to milling said at least a first alloying substance, the free-carbon comprising carbon in a form other than a combined form;

providing a substantial portion of carbon for the alloyed end product from the carbide of said at least a first alloying substance; and dry milling the base iron and said at least a first pretreated alloying substance for a period of time sufficient to disperse and embed said at least a first pretreated alloying substance in the base iron to produce said steel alloy powder.

8. The method according to claim 7, wherein said at least a first alloying substance comprises at least one additional alloying component, the steel alloy powder has a predetermined carbon content, the steel alloy powder has a predetermined alloy content of said at least one additional alloying component, and said method further comprises:

providing the at least one additional alloying component as one of:

A) a carbide alloying component,

B) a mixture of carbide alloying component and substantially carbon free alloying component, and C) a substantially carbon free alloying component;

providing an amount of each of:

said carbide of the at least one alloying substance, and said carbide of the at least one additional alloying component, to provide a substantial portion of the predetermined carbon content; and providing an amount of each of:

said carbide of the at least one additional alloying component, and said substantially carbon free alloying component, to provide the predetermined alloy content of the at least one additional alloying component.

9. The method according to claim 8, wherein said at least a first alloying substance comprises vanadium and said method further comprises:

providing at least some of the substantial portion of carbon as vanadium carbide;

providing substantially all of the vanadium as vanadium carbide; and wherein said pretreating of said at least a first alloying substance comprises pretreating a mixture of said vanadium carbide and said at least one additional alloying component to remove oxygen and free carbon from the mixture.

10. The method according to claim 9, wherein: said pretreating comprises:

heating the mixture to a first predetermined temperature in at least one of:

a vacuum, and an inert atmosphere, to remove oxygen from said mixture and permit reaction of the free carbon; and cooling the mixture;

said base iron has a compressibility and said method further comprises the steps of:

annealing the milled steel alloy powder to produce a powder having a compressibility approaching the compressibility of the base iron prior to said milling;

formulation the steel alloy powder to produce a steel alloy powder for high speed steels;

dry milling said high speed steel powder by solid state microblending, said solid state microblending comprises dry milling in a ball mill under an inert atmosphere to disperse and embed the at least one alloying component in the base iron; and said providing of said at least one additional alloying component comprises providing one of the following groups of alloying components:

(D) chromium, tungsten and molybdenum, and (E) chromium, tungsten, molybdenum and cobalt.

11. The method according to claim 10, wherein:

said pretreating comprises removing all of the free carbon from the mixture;

said free carbon comprises at least one of:

elemental carbon, and graphite;

said heating the mixture to a first predetermined temperature comprises heating the mixture to about 1100° C. for 2.5 hours;

said solid state microblending further comprises:

milling in a gravity dependent ball mill with 3/16 inch steel balls at 35–37.5 rpm;

milling under an argon atmosphere;

milling said at least one alloying component for 1 hour;

adding the base iron and milling for 16–20 hours; and annealing the milled powder in an inert atmosphere at a temperature between about 500° C. to about 1000° C. for a respective period of time from about 8 hours at the lower temperature to about 5 minutes at the higher temperature to thereby produce the steel powder having: compressibility similar to that of the base iron, flowability, and sinterability for producing a high speed steel product having a density greater than about 98% of maximum density after compaction and sintering;

said method further comprises producing an alloy metal of one of the following steels: M2 steel, M42 steel, and T15 steel, by mixing said at least a first alloying component to provide one of the following compositions:

| | |
|---|---|
| for the M2 steel: | |
| 5.7–6.0 wt. % | tungsten |
| 4.75–5.0 wt. % | molybdenum |
| 1.90–2.0 wt. % | vanadium |
| 3.80–4.0 wt. % | chromium |
| 0.00–5.0 wt. % | $Al_2O_3$ |
| 1.0 wt. % | carbon |
| balance | iron; |
| for the M42 steel: | |
| 1.6 wt. % | tungsten |
| 9.5 wt. % | molybdenum |
| 1.2 wt. % | vanadium |
| 3.75 wt. % | chromium |
| 8.0 wt. % | cobalt |
| 1.15 wt. % | carbon |
| balance | iron; and |
| for the T15 steel: | |
| 12.0–12.5 wt. % | tungsten |
| 0.0–1.0 wt. % | molybdenum |
| 5.0 wt. % | vanadium |
| 4.25–4.50 wt. % | chromium |
| 5.0 wt. % | cobalt |
| 1.65 wt. % | carbon |
| balance | iron. |

12. The method according to claim 7, wherein said steel alloy powder additionally comprises alumina and said method further comprises the step of:

pretreating the alumina with ferrochromium prior to said milling to increase sinterability of the steel alloy powder and increase bonding with the metallic phase; and milling together the pretreated alumina, base iron, and said at least one alloying substance.

13. The method according to claim 12, wherein said pretreating of the alumina comprises:

mixing the alumina with ferrochromium; and heating the alumina-ferrochromium mixture to a first predetermined temperature in a vacuum to produce the pretreated alumina.

14. The method according to claim 13, wherein said pretreating of the at least a first alloying substance comprises treating the at least a first alloying substance and the pretreated alumina to remove oxygen and free carbon from the at least a first alloying substance and the pretreated alumina, said treating comprising:

heating the pretreated alumina and the at least a first alloying substance to a first predetermined temperature in at least one of:

a vacuum, and an inert atmosphere, to remove oxygen and permit reaction of the free carbon; and cooling the mixture.

15. The method according to claim 14, wherein:

said at least a first alloying substance comprises vanadium, tungsten, molybdenum, and chromium;

said steel alloy powder comprises a predetermined content of each of: carbon, vanadium, tungsten, molybdenum, and chromium;

said treating the at least a first alloying substance and the pretreated alumina comprises removing all of the free carbon from the alloying material;

said free carbon comprises at least one of:

elemental carbon, and graphite;

said heating to a first predetermined temperature comprises heating to about 1093° C. for 2 hours;

said heating the mixture to a second predetermined temperature comprises heating the mixture to about 1100° C. for 2.5 hours; and said solid state microblending further comprises:

milling in a gravity dependent ball mill with 3/16 inch steel balls at 35–37.5 rpm;

milling under an argon atmosphere;

milling said at least one alloying element and said carbon for 1 hour; and adding the base iron and milling for 16–20 hours; and said method further comprises:

providing a substantial portion of the vanadium content as vanadium carbide;

providing at least some of the tungsten, molybdenum, and chromium content as carbides of the tungsten, molybdenum, and chromium;

providing at least some of the substantial portion of the carbon content from the vanadium carbide;

providing a remaining portion of the substantial portion of the carbon content from the carbide of at least one of the tungsten, molybdenum, and chromium;

providing a remaining portion of the tungsten, molybdenum, and chromium content as substantially carbon free tungsten, molybdenum and chromium.

16. A high alloy metal powder for use in powder metallurgy for producing pressed and sintered metal parts and produced by the process according to claim 7.

17. A composite metal powder for use in powdered metallurgy for producing sintered products, said composite metal powder comprising:

a base iron;

carbided alloying components dispersed and embedded in the base iron by solid state microblending, said carbided alloying component for providing a substantial portion of a carbon content of the alloy of the sintered product;

non-carbided alloying components dispersed and embedded in the base iron by solid state microblending, said non-carbided alloying components and said carbided alloying components for providing a non-carbon portion of the alloy of the sintered product; and wherein said carbided alloying components and said non-carbided alloying components are pretreated, separately from said base iron, to remove a substantial portion of oxygen and free carbon from said carbided alloying component and said non-carbided alloying component prior to said solid state microblending.

18. The metal powder according to claim 19, wherein said free carbon comprises at least one of:

elemental carbon; and graphite.

19. The metal powder according to claim 18, wherein said carbided alloying components and non-carbided alloying components have substantially all of the free carbon removed therefrom by the pretreatment prior to said solid state microblending.

20. The metal powder according to claim 19, wherein solely said carbided alloying components and non-carbided alloying components have substantially all of the free carbon removed therefrom by the pretreatment prior to said solid state microblending.

21. The metal powder according to claim 20, wherein said composite metal powder comprises an annealed powder of said base iron powder having said carbided alloying components and non-carbided alloying components dispersed and embedded therein, said annealed powder having been produced by heating said base iron powder having said carbided alloying components and non-carbided alloying components dispersed and embedded therein.

22. The metal powder according to claim 21, wherein said composite metal powder has a compressibility, flowability and sinterability to produce a sintered product having a density greater than about 98% of a maximum density.

23. The metal powder according to claim 22, wherein:

said carbided alloying components and non-carbided alloying components comprise components of: tungsten, molybdenum, chromium, and vanadium;

said metal powder comprises a high alloy metal powder for producing high speed steel products, said high alloy metal powder comprising one of:

an M2 steel powder;

an M42 steel powder; and a T15 steel powder.

* * * * *

UNITED STATES PATENT AND TRADEMARK OFFICE

CERTIFICATE OF CORRECTION

PATENT NO. : 5,328,500

DATED : July 12, 1994

INVENTOR(S) : Robert J. BELTZ, Joseph D. DANKOFF and Melvin MCCLELLAN

It is certified that error appears in the above-indentified patent and that said Letters Patent is hereby corrected as shown below:

In column 17, line 24, Claim 10, before 'the', delete "formulation" and insert --formulating--.

In column 20, line 4, Claim 18, after 'claim', delete "19" and insert --17--.

Signed and Sealed this

First Day of October, 1996

Bruce Lehman

BRUCE LEHMAN

*Commissioner of Patents and Trademarks*

*Attest:*

*Attesting Officer*